US011441337B2

(12) United States Patent
Ney et al.

(10) Patent No.: US 11,441,337 B2
(45) Date of Patent: Sep. 13, 2022

(54) VEHICLE LATCH WITH INTERCHANGEABLE SWITCH CAM LEVER WITH LOST MOTION AND INTERCHANGEABLE SWITCH CAM LEVER

(71) Applicant: Inteva Products, LLC, Troy, MI (US)

(72) Inventors: Daniel Alexander Ney, Lake Orion, MI (US); Donald Michael Perkins, Warren, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 107 days.

(21) Appl. No.: 16/852,442

(22) Filed: Apr. 18, 2020

(65) Prior Publication Data

US 2020/0332573 A1 Oct. 22, 2020

Related U.S. Application Data

(60) Provisional application No. 62/836,035, filed on Apr. 18, 2019.

(51) Int. Cl.
*E05B 81/66* (2014.01)
*E05B 81/70* (2014.01)

(52) U.S. Cl.
CPC ..... *E05B 81/66* (2013.01); *E05B 81/70* (2013.01)

(58) Field of Classification Search
CPC ..... E05B 81/66; E05B 81/68; E05B 81/64; E05B 81/70; E05B 81/42
See application file for complete search history.

(56) References Cited

U.S. PATENT DOCUMENTS

| | | | | |
|---|---|---|---|---|
| 6,499,776 | B2 * | 12/2002 | Takamura | E05B 81/20 292/201 |
| 6,637,783 | B2 * | 10/2003 | Takamura | E05B 81/14 292/201 |
| 6,698,804 | B2 * | 3/2004 | Shiota | E05B 81/20 292/201 |
| 9,714,532 | B2 * | 7/2017 | Peatey | E05B 81/20 |
| 2013/0049379 | A1 * | 2/2013 | Yokota | E05B 85/02 292/129 |

FOREIGN PATENT DOCUMENTS

| | | | | |
|---|---|---|---|---|
| CN | 101109246 A | * | 1/2008 | |
| DE | 102017009900 A1 | * | 4/2019 | E05B 81/68 |

OTHER PUBLICATIONS

Chinese Office Action for Application No. 2020205953.8; dated Jan. 7, 2021.

* cited by examiner

*Primary Examiner* — Kristina R Fulton
*Assistant Examiner* — James E Ignaczewski
(74) *Attorney, Agent, or Firm* — Cantor Colburn LLP

(57) ABSTRACT

A vehicle latch assembly, including: a pawl pivotally mounted to the vehicle latch assembly; a claw pivotally mounted to the vehicle latch assembly; a switch cam lever; a first switch; a second switch, the switch cam lever has a first cam profile configured to engage the first switch and a second cam profile configured to engage the second switch, the first cam profile engaging the first switch; and wherein the second cam profile engages the second switch when the vehicle latch assembly is in a secondary position.

19 Claims, 11 Drawing Sheets

VEHICLE LATCH WITH INTERCHANGEABLE SWITCH CAM LEVER WITH LOST MOTION AND INTERCHANGEABLE SWITCH CAM LEVER

CROSS REFERENCE TO RELATED APPLICATIONS

This application claims the benefit of U.S. Provisional Patent Application No. 62/836,035 filed on Apr. 18, 2019, the contents of which are incorporated herein by reference thereto.

BACKGROUND

Exemplary embodiments of the present disclosure pertain to the art of vehicle latch assemblies or latching systems.

For a family of latching systems, there are typically many different requirements that can vary from customer to customer or even door to door. Controller logic can widely vary customer to customer, and the desired switch or sensors to detect the latch conditions can vary as well. For detecting different conditions for the claw of the latch, a customer may request to have two door ajar switches, that provide redundancy, or a door ajar and a door open switch, to detect the difference between primary and secondary position. The next issue can be packaging size. By using a switch cam, the goal is to take the latch rotational travel of the claw, and transition it to a smaller amount of travel, while also moving the switches to a different position in the latch. The problem can be with most of these switch designs, the activation points that need to be detected on the claw are usually near the end, or after mid travel. That means the first half of rotation of the claw does not need to be detected. Therefore, with a common slot cam design, there will be a lot of unneeded travel by the switch cam, and that can increase mass of the cam lever, and increase the latch package due to the extra required swing clearance for the switch cam lever. The last issue can be electrical circuit carrier (ECC) designs. Over-molded traces can be a very expensive component, and when a latch system has to use multiple ECC designs for different customers due to the switch arrangement they want, that can get very expensive.

BRIEF DESCRIPTION

Disclosed is an interchangeable switch cam lever for a vehicle latch, wherein the interchangeable switch cam lever can have different or common switch activation points.

Also disclosed is a vehicle latch with an interchangeable switch cam lever, wherein the interchangeable switch cam lever can have different or common switch activation points.

Also disclosed is a vehicle latch assembly, including: a pawl pivotally mounted to the vehicle latch assembly; a claw pivotally mounted to the vehicle latch assembly; a switch cam lever; a first switch; a second switch, the switch cam lever has a first cam profile configured to engage the first switch and a second cam profile configured to engage the second switch, the first cam profile engaging the first switch; and wherein the second cam profile engages the second switch when the vehicle latch assembly is in a secondary position.

In addition to one or more of the features described above, or as an alternative to any of the foregoing embodiments, the first cam profile engages the first switch when the vehicle latch assembly is in the secondary position.

In addition to one or more of the features described above, or as an alternative to any of the foregoing embodiments, movement of the switch cam lever is facilitated by a post operably coupled to the claw that slides within a slot of the switch cam lever.

In addition to one or more of the features described above, or as an alternative to any of the foregoing embodiments, the slot has a first portion and a second portion, the second portion being angularly orientated with respect to the first portion such that slidably movement of the post in the second portion will cause less movement of the switch cam lever than slidable movement of the slot in the first portion.

In addition to one or more of the features described above, or as an alternative to any of the foregoing embodiments, movement of the switch cam lever is facilitated by a post operably coupled to the claw that slides within a slot of the switch cam lever.

In addition to one or more of the features described above, or as an alternative to any of the foregoing embodiments, the slot has a first portion and a second portion, the second portion being angularly orientated with respect to the first portion such that slidably movement of the post in the second portion will cause less movement of the switch cam lever than slidable movement of the slot in the first portion.

In addition to one or more of the features described above, or as an alternative to any of the foregoing embodiments, the first cam profile does not engage the first switch when the vehicle latch assembly is in the secondary position.

In addition to one or more of the features described above, or as an alternative to any of the foregoing embodiments, movement of the switch cam lever is facilitated by a post operably coupled to the claw that slides within a slot of the switch cam lever.

In addition to one or more of the features described above, or as an alternative to any of the foregoing embodiments, the slot has a first portion and a second portion, the second portion being angularly orientated with respect to the first portion such that slidably movement of the post in the second portion will cause less movement of the switch cam lever than slidable movement of the slot in the first portion.

In addition to one or more of the features described above, or as an alternative to any of the foregoing embodiments, the first cam profile engages the first switch when the vehicle latch assembly is in an open position.

In addition to one or more of the features described above, or as an alternative to any of the foregoing embodiments, the first cam profile engages the first switch when the vehicle latch assembly is in an open position.

In addition to one or more of the features described above, or as an alternative to any of the foregoing embodiments, the first cam profile does not engage the first switch when the vehicle latch assembly is in the secondary position.

In addition to one or more of the features described above, or as an alternative to any of the foregoing embodiments, the first switch is a door open switch and the second switch is a door ajar switch.

Also disclosed is a method of actuating switches of a vehicle latch assembly, including: pivotally mounting a pawl to the vehicle latch assembly; pivotally mounting a claw to the vehicle latch assembly; pivotally mounting a switch cam lever to the vehicle latch assembly; engaging a first switch with a first cam profile of the switch cam lever and engaging a second switch with a second cam profile as the switch cam lever pivots; and wherein the second cam profile engages the second switch when the vehicle latch assembly is in a secondary position.

In addition to one or more of the features described above, or as an alternative to any of the foregoing embodiments, the first cam profile engages the first switch when the vehicle latch assembly is in the secondary position.

In addition to one or more of the features described above, or as an alternative to any of the foregoing embodiments, movement of the switch cam lever is facilitated by a post operably coupled to the claw that slides within a slot of the switch cam lever.

In addition to one or more of the features described above, or as an alternative to any of the foregoing embodiments, the slot has a first portion and a second portion, the second portion being angularly orientated with respect to the first portion such that slidably movement of the post in the second portion will cause less movement of the switch cam lever than slidable movement of the slot in the first portion.

In addition to one or more of the features described above, or as an alternative to any of the foregoing embodiments, the first cam profile engages the first switch when the vehicle latch assembly is in an open position.

In addition to one or more of the features described above, or as an alternative to any of the foregoing embodiments, the first cam profile does not engage the first switch when the vehicle latch assembly is in the secondary position.

In addition to one or more of the features described above, or as an alternative to any of the foregoing embodiments, the first switch is a door open switch and the second switch is a door ajar switch.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Disclosed herein is a more efficient, versatile and cost effective way of providing multiple options for detecting various switch designs in the same system. The concept of this design is using a secondary lever to activate the switches for a system. The component that is activating the switches can vary from gear positions, claw positions, pawl positions etc.

For the below description the claw is the component whose movement is being detected is the claw however, this concept can be applied to various other systems of components of various other systems.

There are two primary purposes for the present disclosure. The first purpose of this is to provide a solution for meeting all of the potential needs that a customer may request for switch signals, and allowing the only required modifications to achieve those differences to be to a small, cheaper lever. The electrical circuit carrier (ECC) should be able to remain common. This is achieved by the design of a cam profile that interfaces with the switches. The cam profile should have a specific cam activation surface (the surface where the cam presses in the plunger) for each switch that it is activating. Then for each switch that needs to be activated, that single cam surface can be modified in order to achieve different switch states. Therefore, once the system is designed, there would be a series of different switch cam levers available to meet whatever that particular customer's needs are.

The second purpose is to design the switch cam lever's interface to the claw such that the switch lever will only rotate when it needs to activate the switches. This is where the loss of motion portion of the slot comes in. The claw will interface to the switch cam lever using a post and slot design. The slot will be arranged so that the switch cam lever will not move for a portion of the claws travel, and once it is at a point where a switch will need to be activated, the slot will no longer provide lost motion, and will start to drive the switch cam lever. This allows for fine tuning of the overall travel of the switch cam, which can be beneficial to the package size, and maintaining clearance to other components in the system.

The interface between these two concepts is what makes it so versatile. By determining all of the potential options for switch activations that may need to be required, either one or more slot profiles can be determined to provide the lost motion where needed, and the boss on the driving component can remain the same.

Figure 1B:
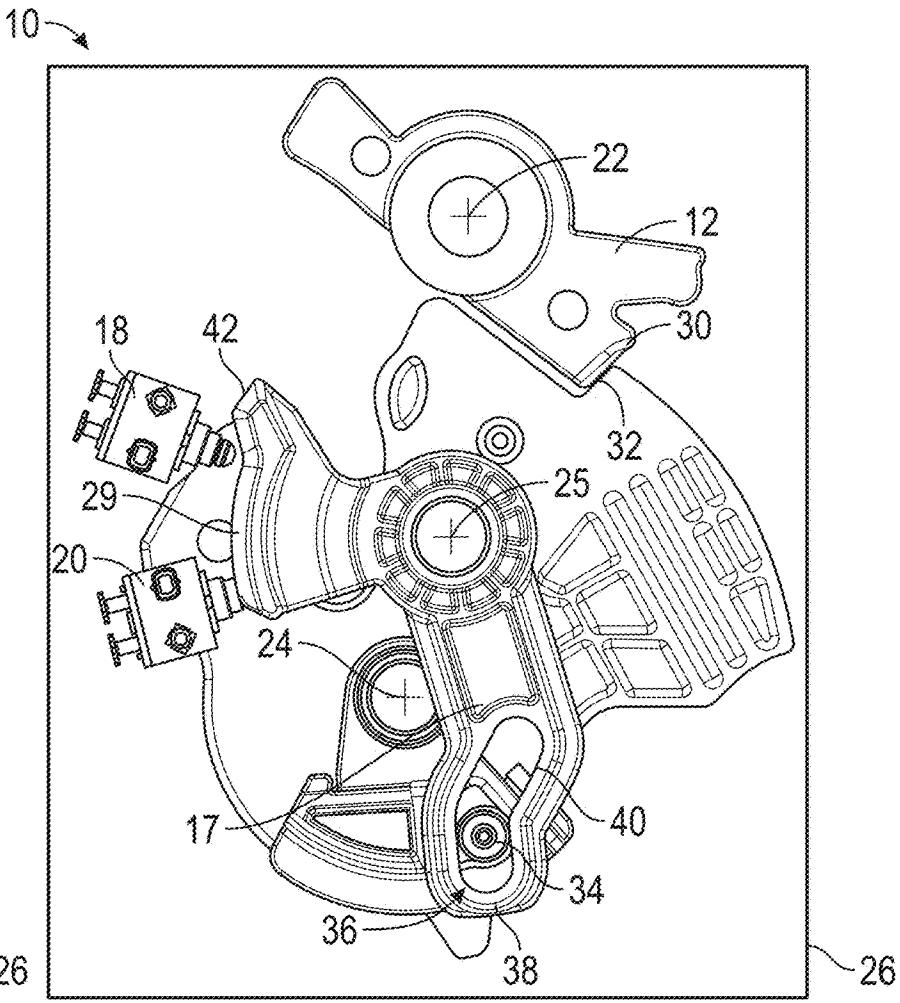
FIG. 1B illustrates a latch in a secondary position with a switch cam with different activation points.
Figure 1A:
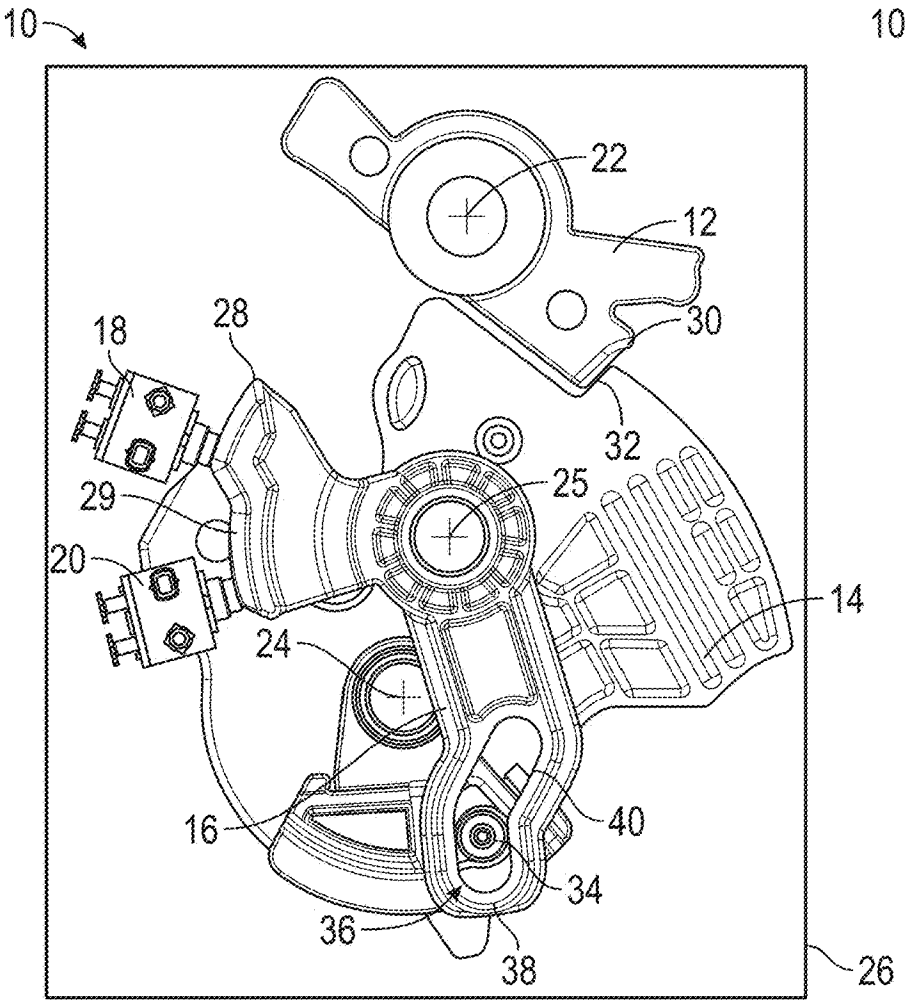
FIG. 1A illustrates a latch in a secondary position with a switch cam having common switch activation points.

Referring now to FIGS. 1A and 1B components of a latch 10 are illustrated in a secondary position (between an open position and a closed or primary position) where a pawl or detent lever 12 is engaging a claw or forkbolt 14 of the latch 10. This may also be referred to a door ajar position. The claw 14 is configured to engage and pivot or rotate a switch cam lever 16, 17 as the claw 14 rotates. The switch cam lever 16, 17 is configured to actuate a first switch 18 and a second switch 20 as the switch cam lever 16 is rotated. In one embodiment, the first switch 18 and the second switch 20 are a door open switch 18 and a door ajar switch 20 operably coupled to a microprocessor or latch control unit for controlling operation of the latch 10. The pawl 12 is configured to pivot or rotate about an axis 22 while the claw 14 is configured to pivot or rotate about an axis 24 and the switch cam lever 16, 17 is configured to rotate about an axis 25. It being understood that the pawl 12, claw 14 and the switch cam lever 16, 17 are rotatably mounted to a housing, frame or 26 (illustrated schematically) of the latch 10.

For the most part, all of the components in FIG. 1A are the same as those in FIG. 1B except for the switch cam levers 16, 17. In FIG. 1A the switch cam lever 16 is configured with common switch activation points on the switch cam lever 16 while in FIG. 1B the switch cam lever 17 is configured with different switch activation points. In FIG. 1A the switch cam lever 16 has a cam profile 28 for the first switch 18 and a cam profile 29 for the second switch 20. In FIG. 1A the cam profile 28 of the switch cam lever 16 is configured to actuate the first switch 18 when the latch is in the secondary position such than a portion or surface 30 of the pawl 12 engages a portion or surface 32 of the claw 14. In FIG. 1A both the first switch 18 and the second switch 20 are actuated by the switch cam lever 16 when the latch 10 is in the secondary position illustrated in FIG. 1A.

Movement of the switch cam lever 16 is facilitated by a post 34 operably coupled to the claw 14 that slides within a slot 36 of the switch cam lever 16. As illustrated, slot 36 has a first portion 38 and a second portion 40, the second portion 40 being angularly orientated with respect to the first portion 38.

In FIG. 1B and as mentioned above, all of the components in FIG. 1A are the same as those in FIG. 1B except for the switch cam lever 17. In FIG. 1B the switch cam lever 17 is configured with different switch activation points while in FIG. 1A the switch cam lever 16 is configured with common switch activation points. In FIG. 1B, the switch cam lever 17 has a cam profile 42 that is configured such that the first switch 18 is not actuated by the latch 10 is in the secondary position illustrated in FIG. 1B. As such, the latch 10 of FIG. 1A will actuate both the first switch 18 and the second switch 20 when the latch 10 is in the secondary position and the latch 10 of FIG. 1B will actuate only the second switch 20 when the latch 10 is in the secondary position. This is achieved by simply replacing the switch cam lever 16 of the latch 10 in FIG. 1A with the switch cam lever 17 of the latch 10 in FIG. 1B.

Figure 2:
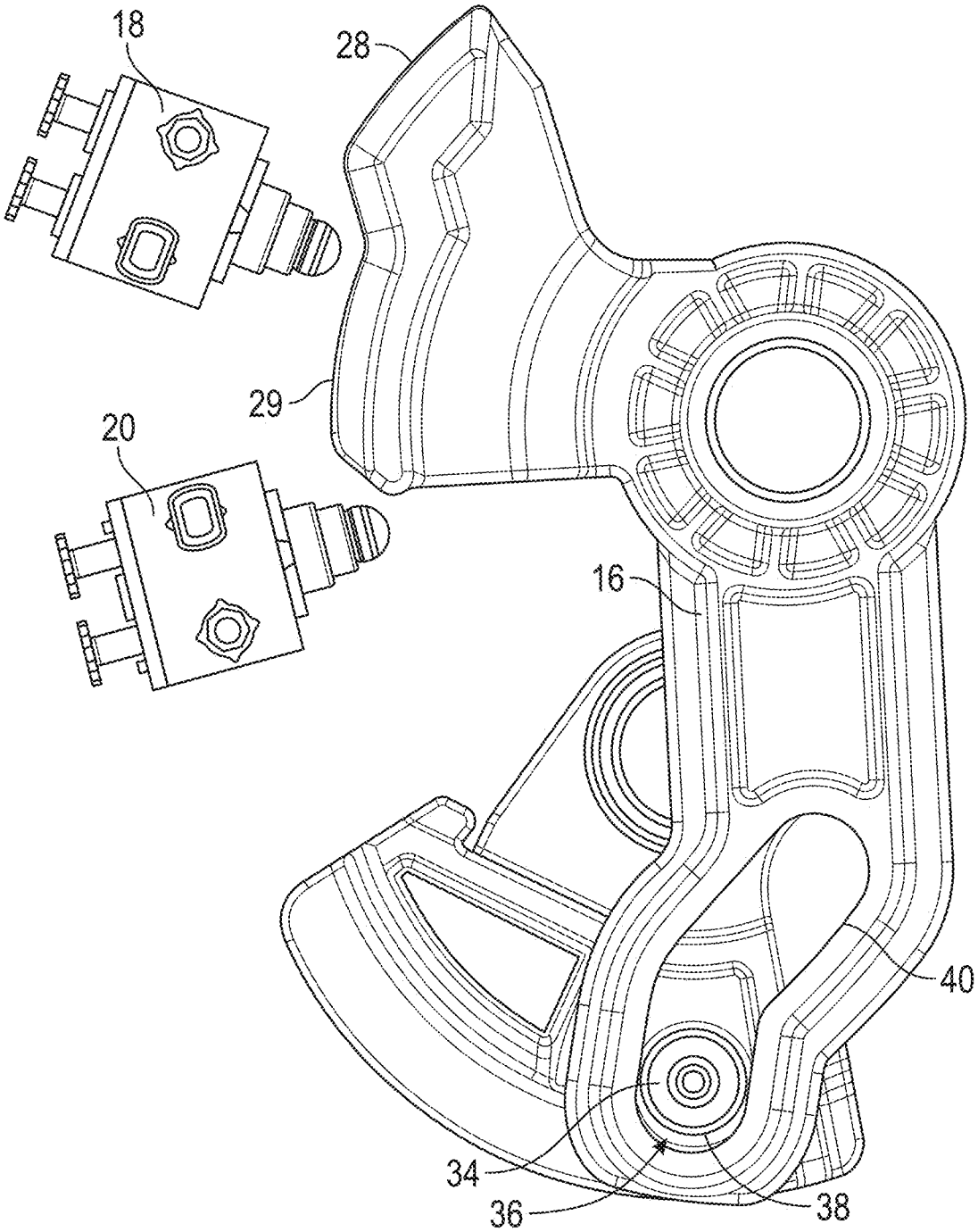
FIG. 2 illustrates a switch cam with common switch activation points wherein the switch cam is orientated in the position right after the switches have been turned off.
Figure 3:
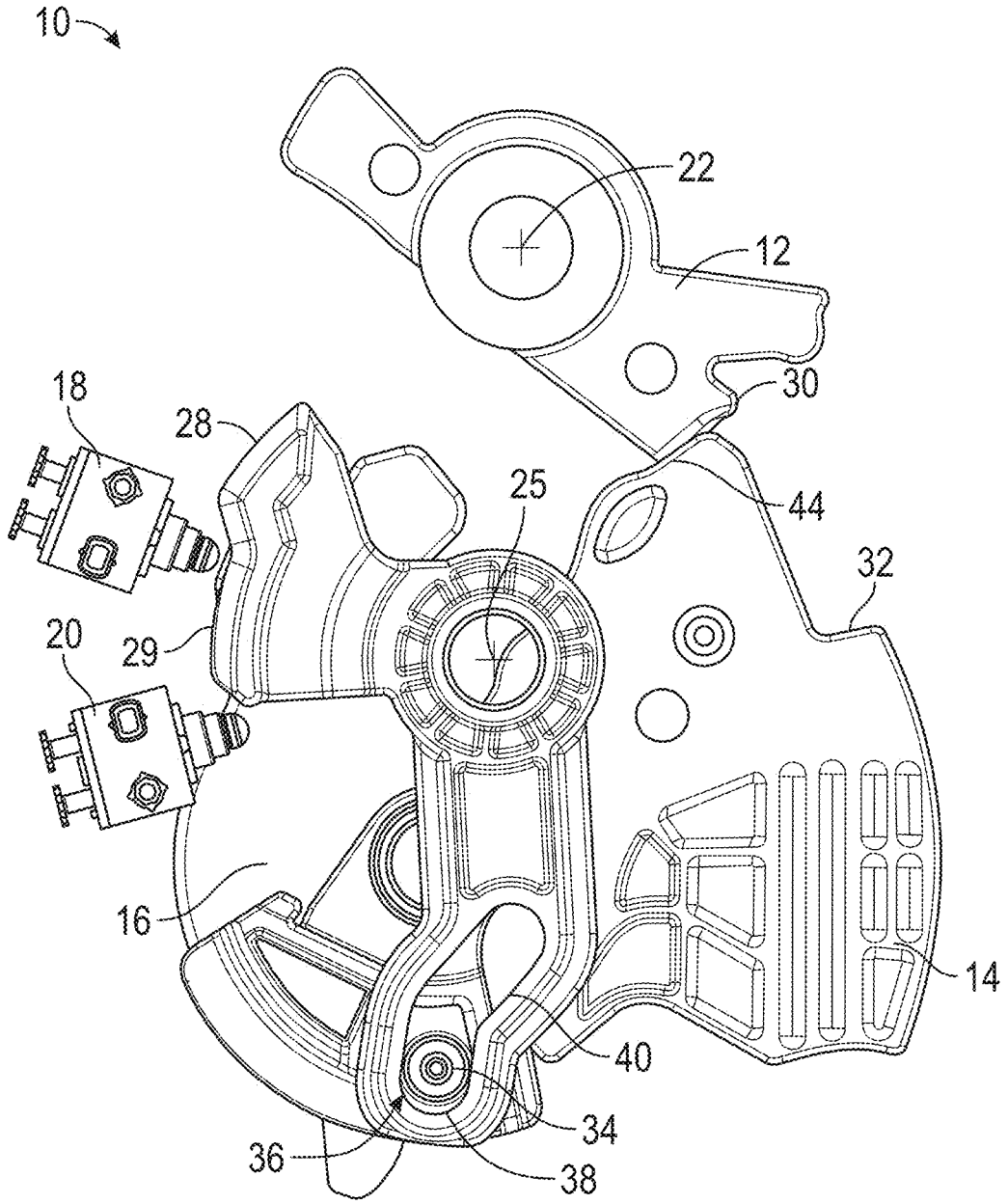
FIG. 3 illustrates a latch in a primary (closed) position with a switch cam with common switch activation points wherein the switch cam is orientated in the position right after the switches have been turned off.

FIGS. 2 and 3 illustrate the switch cam lever 16 with common activation points or cam surfaces 28 and 29 wherein the switch cam lever 16 is orientated in a position where both switches 18 and 20 are not actuated or turned off, which may correspond to the primary or closed position of the latch 10. In this position, the claw 14 is in the closed position and the pawl 12 via portion or surface 30 of the pawl 12 engages a portion or surface 44 of the claw 14.

Figure 4:
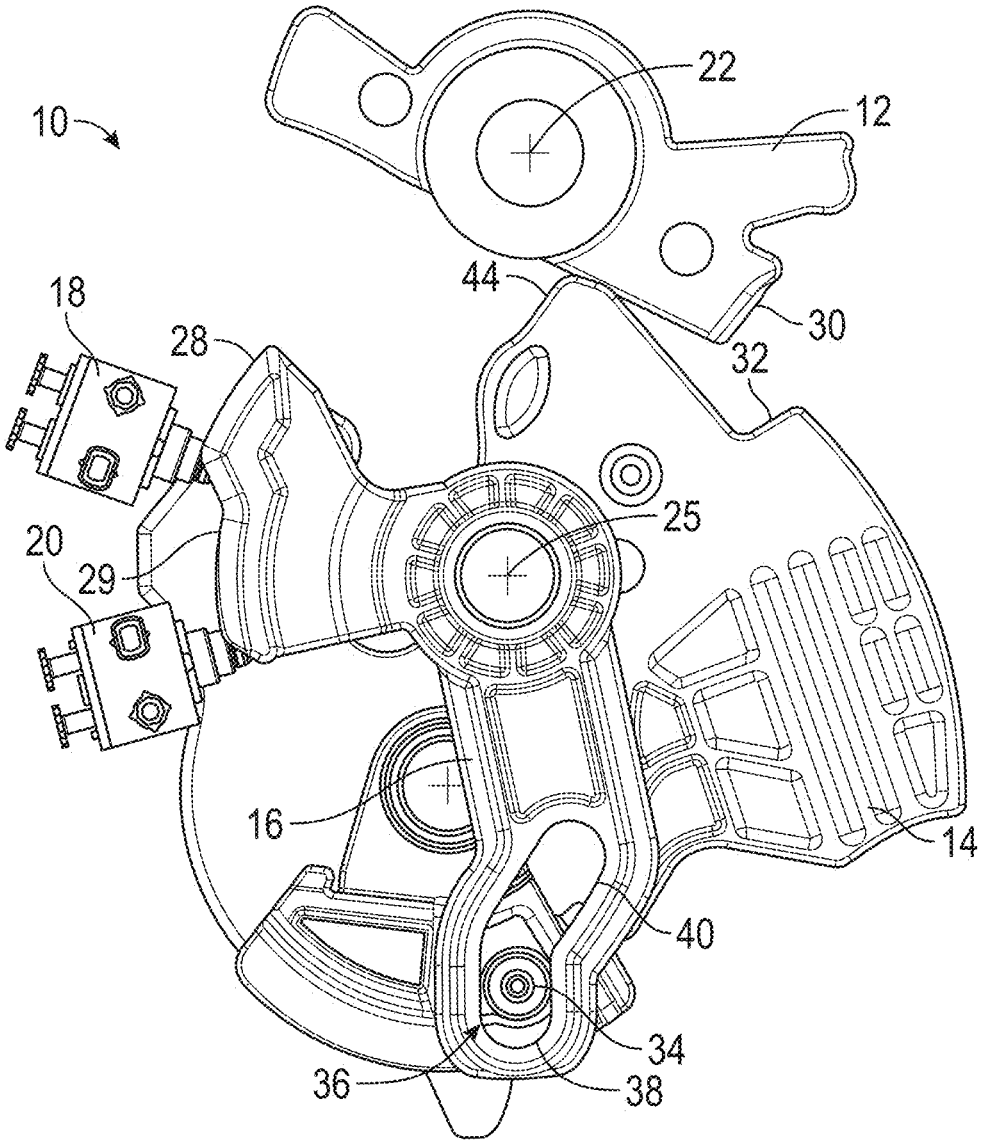
FIG. 4 illustrates a latch between the primary (closed) position and a secondary position with a switch cam with common switch activation points wherein the switch cam is compressing the switches and they are closed.

In FIG. 4 the latch 10 is between a primary and secondary position and the switch cam lever 16 with common activation points or cam surfaces 28 and 29 are orientated in a position where both switches 18 and 20 are actuated or turned on.

Figure 5:
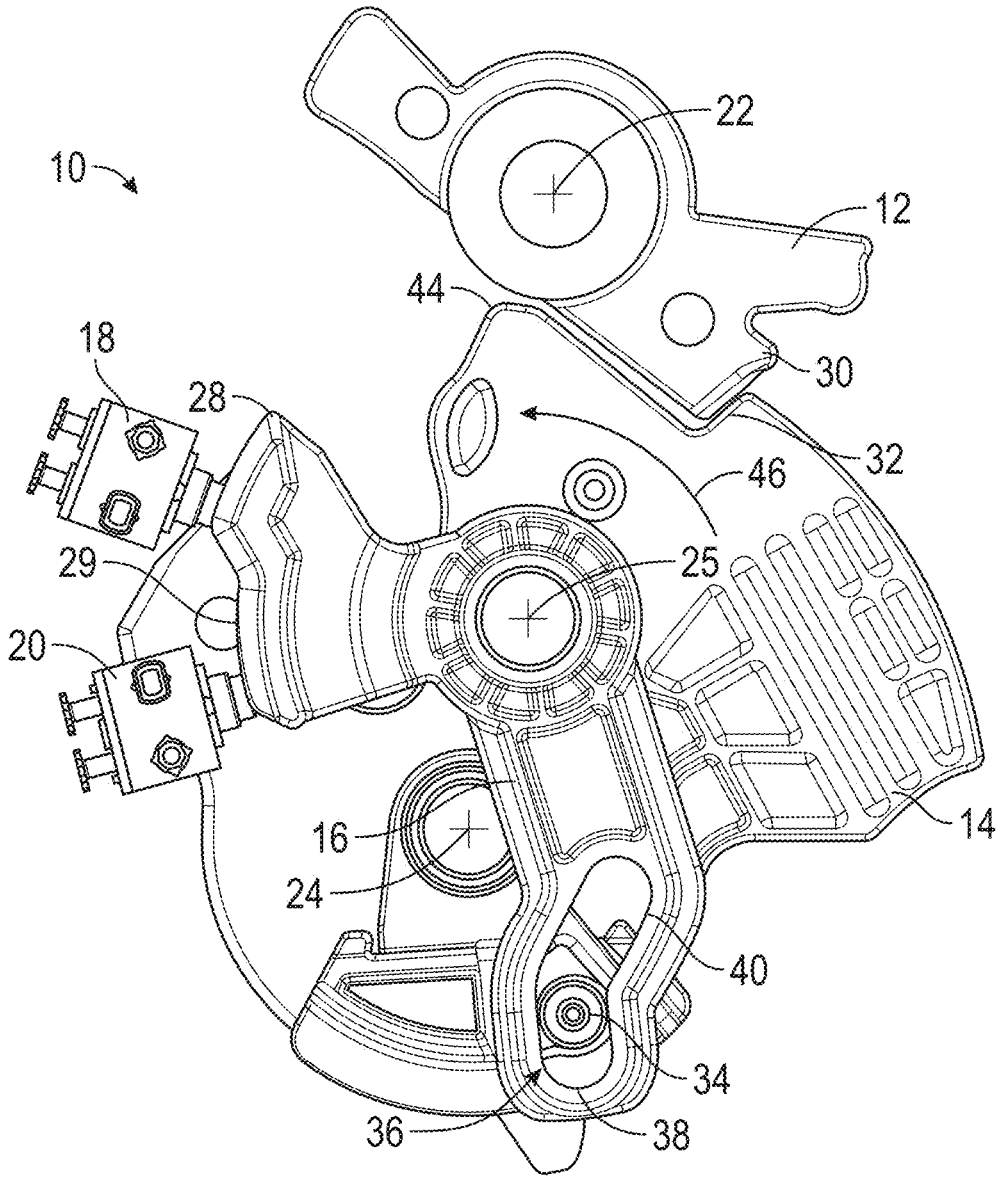
FIG. 5 illustrates a latch in a secondary position with a switch cam with common switch activation points wherein the switch cam is compressing the switches and they are closed.

In FIG. 5 the latch 10 is in a secondary position and the switch cam lever 16 with common activation points or cam surfaces 28 and 29 are orientated in a position where both switches 18 and 20 are actuated or turned on.

Figure 6:
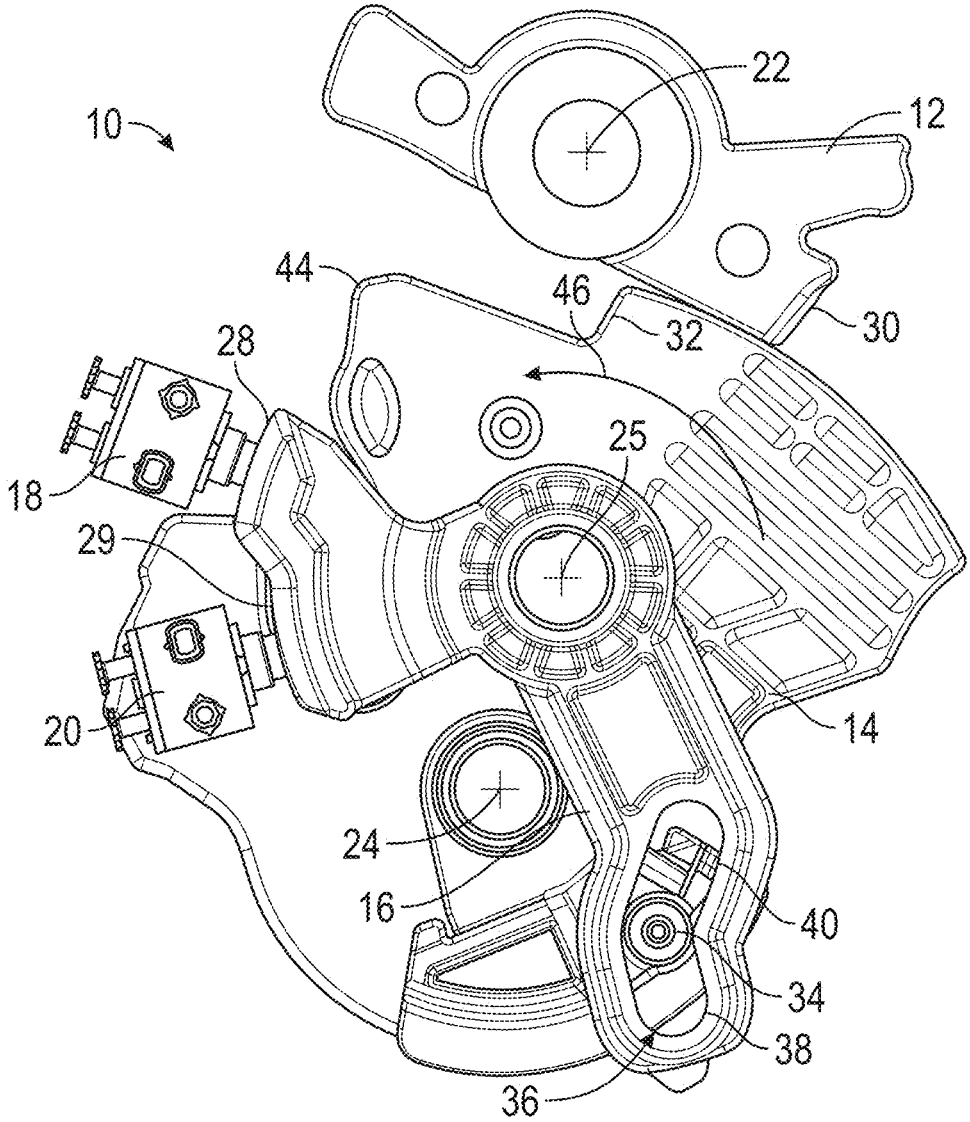
FIG. 6 illustrates a latch between a secondary position and a full open position with a switch cam with common switch activation points wherein the switch cam is compressing the switches and they are closed.

In FIG. 6 the latch 10 is between the secondary position and a full open position and the switch cam lever 16 with common activation points or cam surfaces 28 and 29 are orientated in a position where both switches 18 and 20 are actuated or turned on. Since the switches 18 and 20 only need to be actuated right before the primary position and for certain systems right before the secondary position there is no longer any need for the switch cam lever 16 to move as the claw 14 continues to open by rotating in the direction of arrow 46. During this movement of claw 14 in the direction of arrow 46 post 34 slides within second portion 40 of slot 36 so that no further rotation of the switch cam lever 16 occurs as the claw 14 rotates in the direction of arrow 46. This may be referred to a lost motion slot (e.g., second portion 40).

Figure 7:
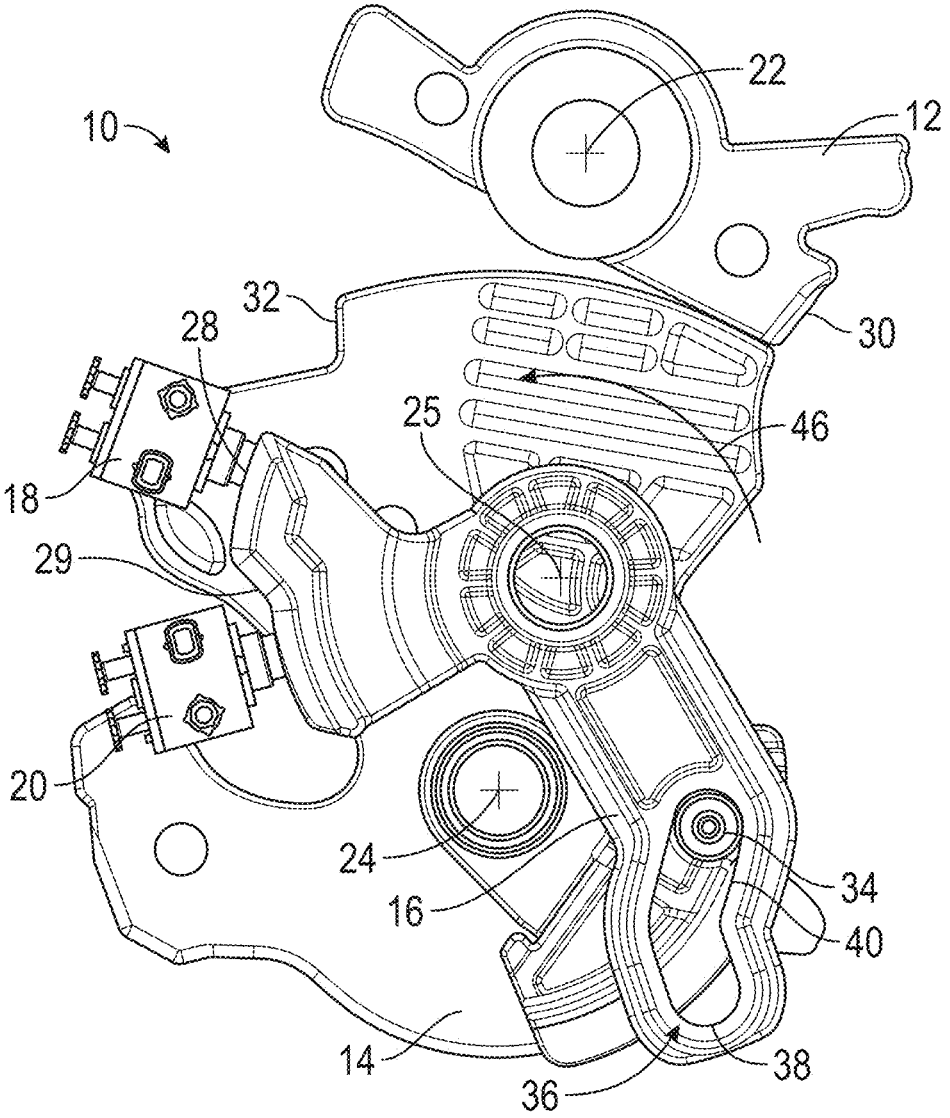
FIG. 7 illustrates a latch in a full open position with a switch cam with common switch activation points wherein the switch cam is compressing the switches and they are closed.

In FIG. 7 the latch 10 is in a full open position and the switch cam lever 16 with common activation points or cam surfaces 28 and 29 are orientated in a position where both switches 18 and 20 are actuated or turned on and post 34 has slid within second portion 40 of slot 36 so that no further rotation or minimum rotation of the switch cam lever 16 occurs as the claw 14 rotates from the position illustrated in FIG. 6 to the full open position in the direction of arrow 46.

Figure 8:
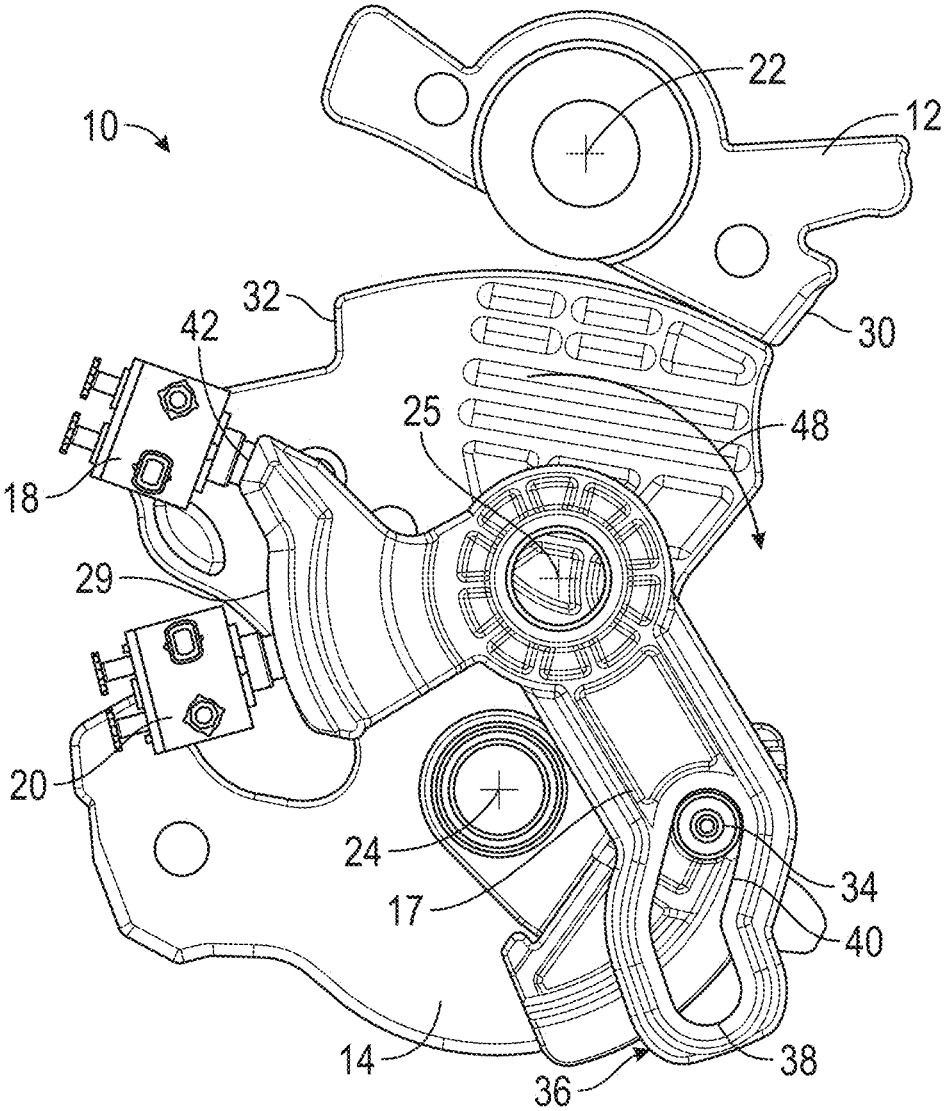
FIG. 8 illustrates a latch in a full open position with a switch cam with different switch activation points wherein the switch cam is compressing the switches and they are closed.

Referring now to FIG. 8, the latch 10 is provided with a switch cam lever 17 that has a different configuration from that of switch cam lever 16. In FIG. 8 the latch 10 is in a full open position. In this position, the cam profile 42 of the switch cam lever 17 engages and actuates the first switch 18 and the cam profile 29 is engages and actuates the second switch 20. Since the switches 18 and 20 only need to be actuated right before the primary position and for the design illustrated in FIG. 8 right before the secondary position there is no need for the switch cam lever 17 to continue to rotate as the latch 10 continued to open. As such and as mentioned above, the second portion 40 of slot 36 allows post 34 to travel therein without causing movement of the switch cam lever 17.

Figure 9:
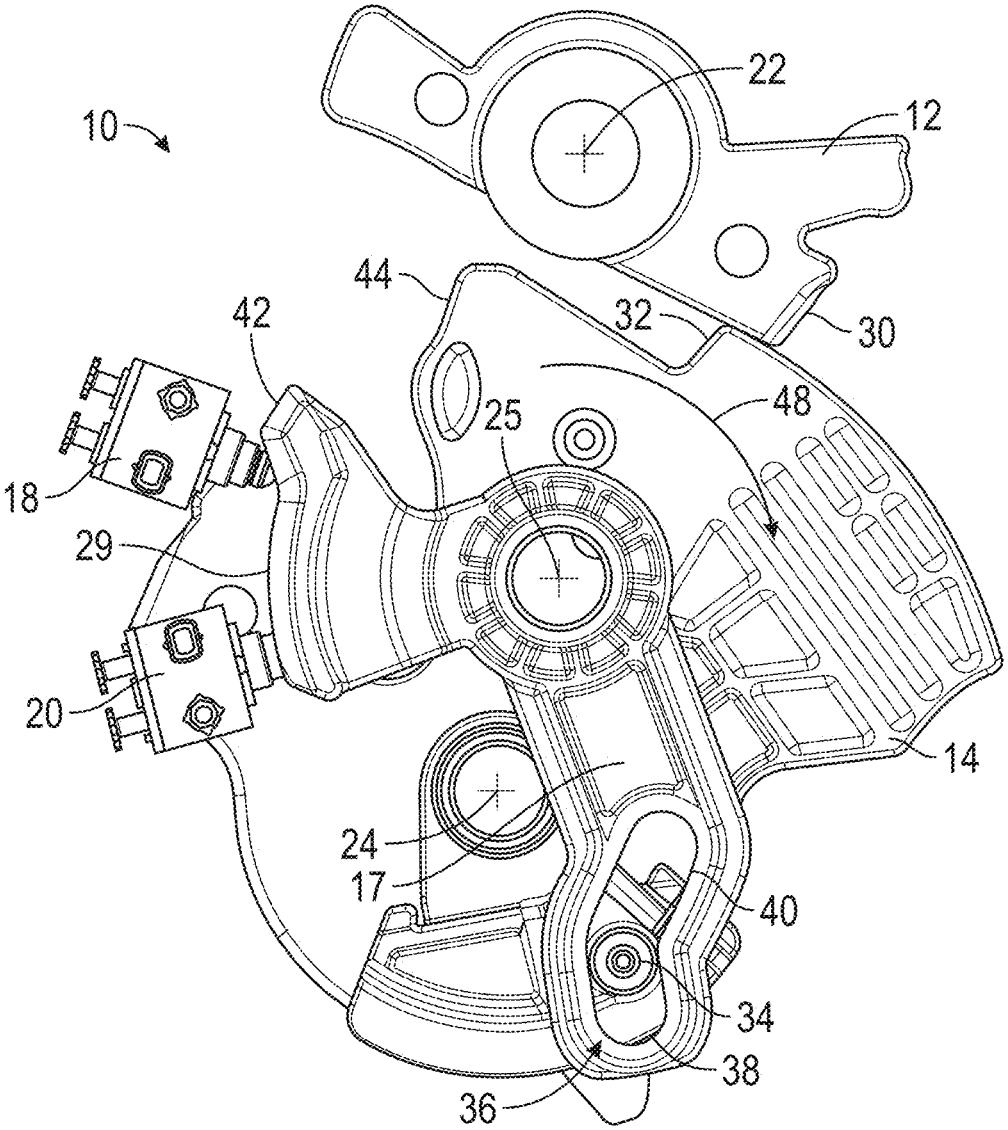
FIG. 9 illustrates a latch between a full open position and a secondary position with a switch cam with different switch activation points wherein the switch cam is compressing only one of the switches and it is closed.

Referring now to FIG. 9 the claw 14 has rotated from the full open position of FIG. 8 in the direction of arrow 48 to a position between the full open position and the secondary position, which is closer to the secondary position. Here the door open switch or the first switch 18 is no longer actuated and the door ajar switch or the second switch 20 is actuated.

Figure 10:
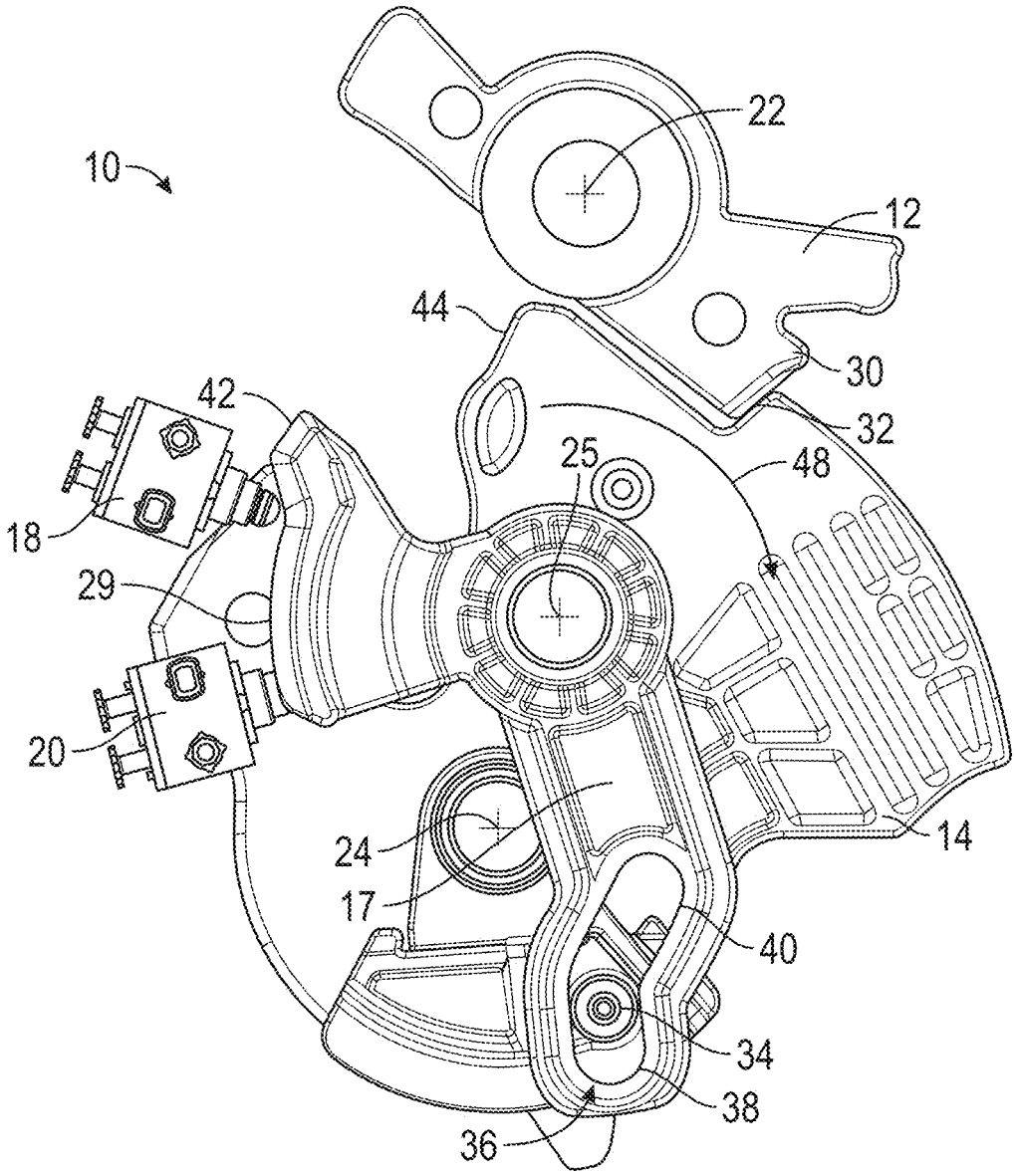
FIG. 10 illustrates a latch in a secondary position with a switch cam with different switch activation points wherein the switch cam is compressing only one of the switches and it is closed.

In FIG. 10 the latch 10 is in a secondary position and the claw 14 has rotated from the position of FIG. 9 in the direction of arrow 48. Here the portion or surface 30 of the pawl 12 engages the portion or surface 32 of the claw 14. In this position, the door open switch or the first switch 18 is no longer actuated and the door ajar switch or the second switch 20 is actuated.

Figure 11:
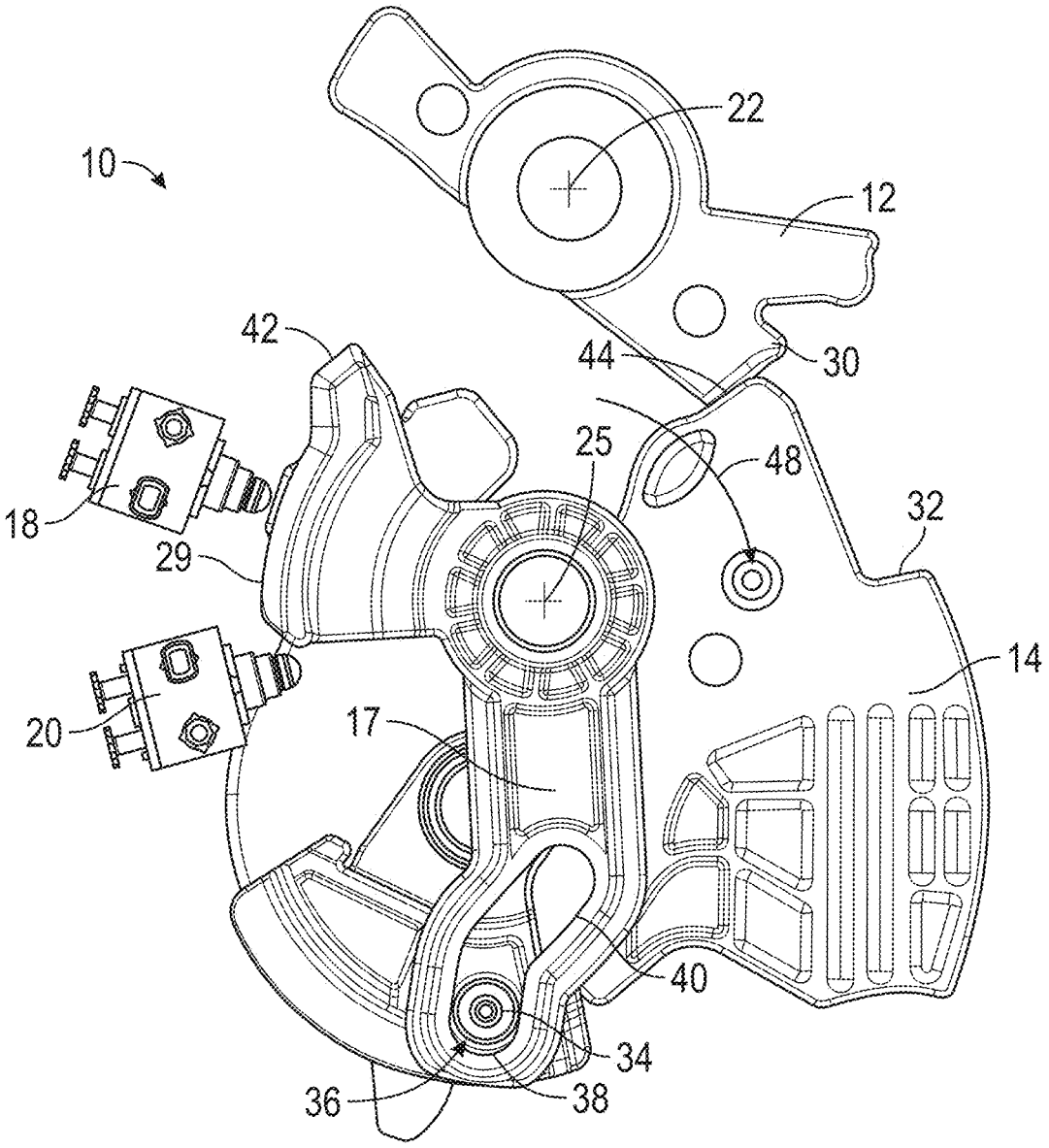
FIG. 11 illustrates a latch in a primary position with a switch cam with different switch activation points wherein the switch cam is not compressing the switches and they are open or released.

In FIG. 11 the latch 10 is in a primary or closed position and the claw 14 has rotated from the position of FIG. 10 in the direction of arrow 48, which also causes rotational movement of the switch cam lever 17. Here the portion or surface 30 of the pawl 12 engages the portion or surface 44 of the claw 14. In this position, the door open switch or the first switch 18 is no longer actuated and the door ajar switch or the second switch 20 is also no longer actuated.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A vehicle latch assembly, comprising:

a pawl pivotally mounted to the vehicle latch assembly;

a claw pivotally mounted to the vehicle latch assembly for rotation about a first axis;

a switch cam lever rotatably mounted to the vehicle latch assembly for rotation about a second axis, the first axis being parallel to and offset from the second axis;

a first switch;

a second switch, the switch cam lever has a first cam profile configured to engage the first switch and a second cam profile configured to engage the second switch, the first cam profile engaging the first switch when the latch assembly is in an open position; and the second cam profile engages the second switch when the vehicle latch assembly is in a secondary position.

2. The vehicle latch assembly as in claim 1, wherein the first cam profile engages the first switch when the vehicle latch assembly is in the secondary position.

3. The vehicle latch assembly as in claim 2, wherein movement of the switch cam lever is facilitated by a post mounted to the claw and the post slides within a slot of the switch cam lever.

4. The vehicle latch assembly as in claim 3, wherein the slot has a first portion and a second portion, the second portion being angularly orientated with respect to the first portion such that slidably movement of the post in the second portion will cause less movement of the switch cam lever than slidable movement of the slot in the first portion.

5. The vehicle latch assembly as in claim 1, wherein movement of the switch cam lever is facilitated by a post mounted to the claw and the post slides within a slot of the switch cam lever.

6. The vehicle latch assembly as in claim 5, wherein the slot has a first portion and a second portion, the second portion being angularly orientated with respect to the first portion such that slidably movement of the post in the second portion will cause less movement of the switch cam lever than slidable movement of the slot in the first portion.

7. The vehicle latch assembly as in claim 1, wherein the first cam profile does not engage the first switch when the vehicle latch assembly is in the secondary position.

8. The vehicle latch assembly as in claim 7, wherein movement of the switch cam lever is facilitated by a post mounted to the claw and the post slides within a slot of the switch cam lever.

9. The vehicle latch assembly as in claim 8, wherein the slot has a first portion and a second portion, the second portion being angularly orientated with respect to the first portion such that slidably movement of the post in the second portion will cause less movement of the switch cam lever than slidable movement of the slot in the first portion.

10. The vehicle latch assembly as in claim 9, wherein the first cam profile engages the first switch when the vehicle latch assembly is in an open position.

11. The vehicle latch assembly as in claim 1, wherein the first cam profile engages the first switch when the vehicle latch assembly is in an open position.

12. The vehicle latch assembly as in claim 11, wherein the first cam profile does not engage the first switch when the vehicle latch assembly is in the secondary position.

13. The vehicle latch assembly as in claim 1, wherein the first switch is a door open switch and the second switch is a door ajar switch.

14. A method of actuating switches of a vehicle latch assembly, comprising:

pivotally mounting a pawl to the vehicle latch assembly;

pivotally mounting a claw to the vehicle latch assembly for rotation about a first axis;

pivotally mounting a switch cam lever to the vehicle latch assembly for rotation about a second axis, the first axis being parallel to and offset from the second axis;

engaging a first switch with a first cam profile of the switch cam lever and engaging a second switch with a second cam profile as the switch cam lever pivots; and wherein the second cam profile engages the second switch when the vehicle latch assembly is in a secondary position and movement of the switch cam lever is facilitated by a post mounted to the claw that slides within a slot of the switch cam lever.

15. The method as in claim 14, wherein the first cam profile engages the first switch when the vehicle latch assembly is in the secondary position.

16. The method as in claim 14, wherein the slot has a first portion and a second portion, the second portion being angularly orientated with respect to the first portion such that slidably movement of the post in the second portion will cause less movement of the switch cam lever than slidable movement of the slot in the first portion.

17. The method as in claim 14, wherein the first cam profile engages the first switch when the vehicle latch assembly is in an open position.

18. The method as in claim 14, wherein the first cam profile does not engage the first switch when the vehicle latch assembly is in the secondary position.

19. The method as in claim 14, wherein the first switch is a door open switch and the second switch is a door ajar switch.

* * * * *